US012612924B2

(12) United States Patent
Loercher et al.

(10) Patent No.: US 12,612,924 B2
(45) Date of Patent: Apr. 28, 2026

(54) AXIAL, DIAGONAL OR RADIAL FAN HAVING A HUB CONTOUR

(71) Applicant: ZIEHL-ABEGG SE, Künzelsau (DE)

(72) Inventors: Frieder Loercher, Braunsbach (DE); Sandra Hub, Pfedelbach (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 18/712,026

(22) PCT Filed: Nov. 28, 2022

(86) PCT No.: PCT/DE2022/200278

§ 371 (c)(1),
(2) Date: May 21, 2024

(87) PCT Pub. No.: WO2023/110028

PCT Pub. Date: Jun. 22, 2023

(65) Prior Publication Data

US 2024/0410387 A1 Dec. 12, 2024

(30) Foreign Application Priority Data

Dec. 13, 2021 (DE) ..... 102021214267.2

(51) Int. Cl.
*F04D 29/32* (2006.01)
*F04D 25/06* (2006.01)
(Continued)

(52) U.S. Cl.
CPC ..... *F04D 29/329* (2013.01); *F04D 25/0606* (2013.01); *F04D 25/0613* (2013.01);
(Continued)

(58) Field of Classification Search
None
See application file for complete search history.

(56) References Cited

U.S. PATENT DOCUMENTS 5,944,497 A * 8/1999 Kershaw ..... F04D 29/5806 417/368
8,974,199 B2 * 3/2015 Schmid ..... G01M 1/32 417/423.7
(Continued)

FOREIGN PATENT DOCUMENTS

CN 212536105 2/2021
DE 202004010088 U1 9/2004
(Continued)

OTHER PUBLICATIONS

International Search Report and Written Opinion issued in App. No. PCT/DE2022/200278, dated Mar. 20, 2023, 13 pages.
(Continued)

*Primary Examiner* — Juan G Flores
(74) *Attorney, Agent, or Firm* — FisherBroyles, LLP; Jason P. Mueller

(57) ABSTRACT

An axial, diagonal or radial fan having an impeller driven by an electric external rotor motor, wherein the impeller comprises a hub ring carrying blades and which is connected in a rotationally fixed manner to the rotor, and wherein a hub contour is provided on the inflow side on the hub ring, which hub contour has a flow-guiding outer surface and a central opening adjoining the outer surface radially inwards with an inner surface directed towards the rotor.

9 Claims, 11 Drawing Sheets

(51) Int. Cl.
*F04D 29/26* (2006.01)
*F04D 29/28* (2006.01)
*F04D 29/64* (2006.01)

(52) U.S. Cl.
CPC ..... *F04D 29/263* (2013.01); *F04D 29/281* (2013.01); *F04D 29/646* (2013.01)

(56) References Cited

U.S. PATENT DOCUMENTS

| | | | | |
|---|---|---|---|---|
| 9,182,008 | B2 | 11/2015 | Liedel | |
| 2012/0177515 | A1* | 7/2012 | Schmid | G01M 1/32 417/423.14 |
| 2019/0093662 | A1* | 3/2019 | Inouchi | F04D 29/329 |
| 2019/0285076 | A1 | 9/2019 | Okuda | |
| 2022/0099106 | A1 | 3/2022 | Huang | |

FOREIGN PATENT DOCUMENTS

| | | | |
|---|---|---|---|
| DE | 202010011378 | U1 | 11/2011 |
| DE | 102011015784 | A1 | 2/2012 |
| DE | 102014225688 | B3 | 3/2016 |
| DE | 102015216579 | A1 | 3/2017 |
| DE | 102018128792 | | 5/2020 |
| EP | 3789617 | | 3/2021 |
| WO | 2023110028 | A1 | 6/2023 |

OTHER PUBLICATIONS

International Preliminary Report on Patentability issued in App. No. PCT/DE2022/200278, dated Jun. 13, 2024, 8 pages.

* cited by examiner

AXIAL, DIAGONAL OR RADIAL FAN HAVING A HUB CONTOUR

CROSS REFERENCE

This application is a national stage entry application under 35 U.S.C. 371 of PCT Patent Application No. PCT/DE2022/200278 filed on 28 Nov. 2022, which claims priority to German Patent Application No. 10 2021 214 267.2, filed on 13 Dec. 2021 the entire contents of each of which are incorporated herein by reference.

FIELD

The disclosure relates to an axial, diagonal or radial fan with an impeller driven by an electric external rotor motor, wherein the impeller comprises a hub ring carrying the blades and the hub ring is connected in a rotationally fixed manner to a rotor of the motor.

BACKGROUND

Axial, diagonal and radial fans are known in practice in a wide variety of designs. For example only, reference is made to DE 10 2015 216 579 A1.

It is known from practice that aerodynamically shaped inflow contours in the hub region of a fan impeller of axial, diagonal or radial design enable high efficiencies and at the same time low sound power values. Such inflow contours regularly impair engine cooling because they cover the inflow regions of the engine or rotor. This can lead to a loss of engine performance and even bearing damage. In any case, sufficiently good cooling of the motor should be achieved even with high efficiency and low sound power values of the fan.

SUMMARY

The present disclosure is therefore based on the object of designing and developing a fan with aerodynamically shaped inflow contours to promote high efficiencies and low sound power values in such a way that sufficiently good motor cooling is ensured at the same time.

According to the disclosure, the above-mentioned object is, in an embodiment, achieved by the features of claim 1, according to which, in the generic fan, a hub contour is provided on the inflow side on the hub ring, which contour comprises a flow-guiding outer surface and a central opening adjoining the outer surface radially inwardly with an inner surface directed towards the rotor.

According to the disclosure, the combination of an aerodynamic inflow contour with a sufficiently good cooling function on the rotor of an external rotor motor is provided. The external rotor motor can be an EC (Electronically Commutated) synchronous motor, for example with a permanent magnet rotor, or an AC (Alternating Current) asynchronous motor. Despite the axially compact design that is possible with fans with external rotor motors, the technically important cooling of the rotor of the external rotor motor can be ensured or improved. This makes it possible to achieve either higher conveying medium temperatures or, at the same conveying medium temperature, higher motor power and/or drive torques.

The engine cooling is, in an embodiment, achieved by the hub contour provided on the inflow side of the hub ring. At least the cooling is not significantly impaired compared to an open, non-aerodynamically shaped hub region. Sufficient cooling is ensured by the design of the hub contour. By providing a flow-guiding outer surface and a central opening radially inwardly adjoining the outer surface with an inner surface directed towards the rotor, the flow conditions are favored on the one hand and sufficiently good cooling of the rotor by flowing around with sucked-in air is ensured on the other hand.

The hub contour can be realized through various design provisions. For example, the hub contour can be integrated as a single piece into the hub ring of the impeller. An integral construction is advantageous for plastic parts, in an embodiment.

The impeller can be attached to the rotor via the integrated hub contour, by means of screw connections, in an embodiment. These are easy to handle.

It is also conceivable that the hub contour is designed as a separate component and is plugged, clipped or otherwise attached to the impeller in a form-fitting and/or force-fitting and/or material-fitting manner. Simple assembly is always an advantage.

Furthermore, it is conceivable that the hub contour is equipped with active air guiding elements. In this respect, the flow around the rotor bell of the external rotor motor with cooling fluid can also be promoted. In a further embodiment, the outer surface of the hub contour is free of steps, edges, kinks or the like, in an embodiment. The flow-guiding surface thus merges approximately tangentially into the outer contour of the hub ring of the impeller, which is aerodynamically and aeroacoustically advantageous, in an embodiment.

In contrast, the outer surface of the hub contour has a rather sharp-edged or rounded transition, preferably a kind of kink, to the inner surface of the hub contour via the central opening. This also promotes the flow around the rotor bell.

In a further embodiment, for instance in the case of a rotor that projects beyond the hub contour towards the inflow side, elastic blades are provided within the hub contour, preferably on the inner surface of the hub contour. The blades adhere to the surface of the rotor, particularly in the case of rotors with slightly different diameters, and can also be understood as guide elements.

It is also conceivable that the central opening of the hub contour has a structure that influences the flow, a regular or irregular or symmetrical or asymmetrical grid structure, possibly formed around the rotor bell. It is important to note that the opening does not have to be free of any components. On the contrary, measures to influence the flow can also be implemented there.

The previously mentioned structure or grid structure can be arranged and designed in such a way that it extends the outer surface of the hub contour, which again promotes the flow towards the rotor bell.

There are then various possibilities for designing and refining the teaching of the present disclosure. For this purpose, reference should be made on the one hand to the claims subordinate to claim 1 and on the other hand to the following explanation of exemplary embodiments of the hub contour according to the disclosure or a fan provided with this hub contour according to the disclosure, with reference to drawings. In connection with the explanation of the exemplary embodiments of the disclosure with reference to drawings, preferred embodiments and refinements of the teachings are also explained in general.

DETAILED DESCRIPTION OF THE DISCLOSURE

Figure 1:
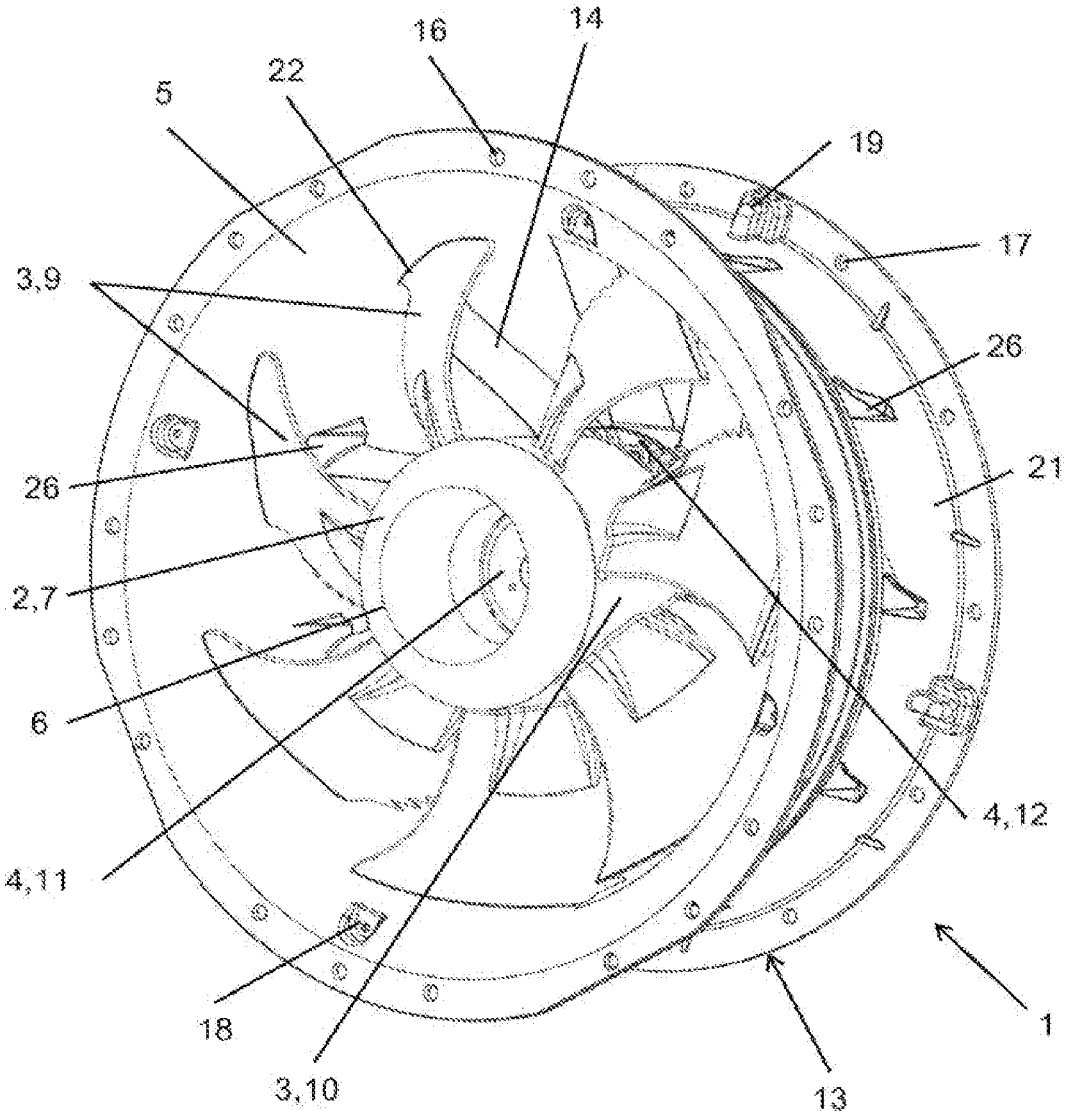
FIG. 1 shows, in a perspective view obliquely seen from the inflow side, a fan with an embodiment of an inflow-side open and aerodynamically designed hub contour, wherein the hub contour is designed as a separate part for attachment to an impeller.

FIG. 1 shows, in a perspective view obliquely seen from the inflow side, a fan 1 with an embodiment of an inflow-side open and aerodynamically designed hub contour 2, wherein the hub contour 2 is designed as a separate part for attachment to the hub ring 10 of the impeller 3. In addition to the hub ring 10, the impeller 3 consists of blades 9 attached to it and extending radially outwards. At the outer end of the blades 9, special contours 22, so-called winglets, are formed, which are advantageous for low noise emissions of the fan 1 during operation.

The impeller 3 of the fan 1 is driven by a motor 4, to the rotor 11 of which it is attached. The motor includes a stator 12 which is attached to a housing 13 with guide vanes 14 which support the motor 4 with the impeller 3. The impeller 3 runs inside the housing 13, which has an integrated inlet nozzle 5 through which the main flow is sucked in during fan operation, and which is then conveyed further through the impeller 3, guide vanes 14 or through a cylindrical part 20 and a diffuser part 21 (see also FIG. 2) of the housing 13 to the outflow side of the fan 1. Various fastening means are integrated into the housing 13, which is, in an embodiment, manufactured using plastic injection molding, namely a fastening device 18 for an inflow-side grid, a fastening device 19 for an outflow-side grid and fastening means 16, 17 for the inflow-side and outflow-side fastening of the housing 13 to a system. Furthermore, in the region of the diffuser 21, demolding regions 26 can be seen both inside and outside, which have the purpose of easier demolding of the housing 13 in the region of the guide vanes 14 in the diffuser region 21 (see also FIG. 2) with a wall thickness distribution of the component that is favorable in terms of plastics technology. The demolding regions 21, which are formed in the region of the suction side of the guide vanes 14, appear on the outer surface of the diffuser 21 as depressions, and on the inner surface as elevations compared to the surrounding contour of the diffuser.

The hub contour 2 attached to the hub ring 10 on the inflow side has a flow-guiding surface 7 which limits the main flow of the air flow conveyed by the fan 1 inwards towards the axis. The flow-guiding surface 7 is designed to be aerodynamically and aeroacoustically advantageous and therefore has a positive effect on the air output, the efficiency and the smooth running of the fan 1 during operation. In an embodiment, it has no steps, edges or kinks and merges approximately tangentially into the outer contour of the hub ring 10 of the impeller 3. It is designed in such a way that from its inflow end, the flow channel for the main fan flow tapers continuously in the axial direction on the hub side. Its outer diameter therefore grows monotonically in an inflow region, with the growth rate decreasing in the flow direction. By way of example only, the flow-guiding surface 7 of the hub contour 2 can have the contour of a conic section, in particular an ellipse or parabola, in cross-section on a plane through the axis. In the exemplary embodiment, the flow-guiding surface 7 of the hub contour 2 has the shape of a solid of revolution. In general, however, it can also be designed in a different form.

It is beneficial that the hub contour 2 does not excessively block or hinder the flow around the rotor 11 of the motor 4 with the conveying medium flowing into the fan 1 through the inlet nozzle 5. This because heat dissipation via the rotor 11 is essential for effective cooling of the motor 4. If the flow around the rotor 11 is good, a significant amount of heat can be transferred to the conveying medium. In order to ensure a flow around the rotor 11, the hub contour 2 is designed to be open on the inside. In the exemplary embodiment, it is provided with an inner opening 6. This is located radially within the flow-guiding surface 7 of the hub contour 2. The inflowing conveying medium can flow directly around the rotor 11 of the motor 4 and dissipate waste heat.

Viewed in the radial direction, the hub contour 2 has two regions, namely an inner region primarily assigned to engine cooling (in the exemplary embodiment, the region of the inner opening 6) and a radial outer region assigned to the main conveying flow (the region of the flow-guiding surface 7). In the exemplary embodiment, the boundary of the opening 6 of the hub contour 2 is designed to be rather sharp-edged towards the outside. It can also be rounded.

Figure 2:
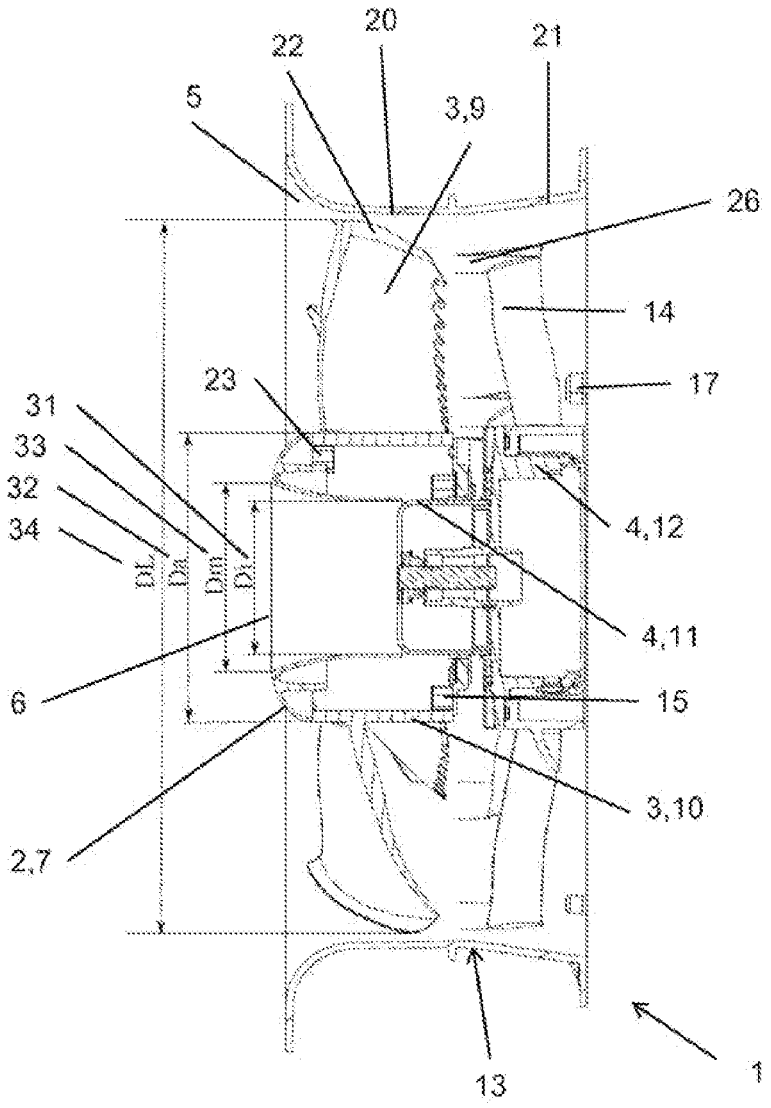
FIG. 2 shows, in section on a plane through the rotation axis of the impeller, seen from the side, the fan according to FIG. 1.

FIG. 2 shows the fan 1 according to FIG. 1, seen from the side, in a section on a plane through the axis of rotation of the impeller 3. In addition to the previous explanations, one can see in particular the contours of the hub contour 2 in section, also showing characteristic dimensions. Thus, the hub contour 2 has an outer, maximum diameter Da 32, which is the radially outer boundary of the hub contour 2. In the exemplary embodiment, it can be defined by the outer boundary of the separate part which can be applied to the hub ring 10 of the impeller 3 and which forms the hub contour 2. It can also, in particular if the hub contour 2 is integrated in one piece into the impeller 3 with its hub ring 10, be defined at the axial location of the outer surface 7 of the hub contour 2 at which the vanes 9 originate from the hub ring. A further possible definition is given by the axial position at which the tangent to the outer surface 7, coming from the inflow side, first runs approximately parallel to the axis.

Furthermore, the hub contour 2 has an inner diameter Di 31, which in the embodiment is provided by the minimum diameter of the hub contour 2. This can, in an embodiment, be similar to the outer diameter of the front part, in particular the rotor bell, of the rotor 11 of the motor 4, so that this region of the motor 4 can be at least largely flowed around or flowed at by cooling conveying medium. In the exemplary embodiment, the hub contour 2 extends axially forward towards the inflow side beyond the rotor 11 of the motor 4. It can also be the other way around, namely that the rotor 11 extends forward beyond the hub contour 2. In the exemplary embodiment, an inner wall extends within the opening 6 of the hub contour 2 from the front end of the hub contour 2 (defined by a mean diameter Dm 33) to the vicinity of the front end of the rotor 11 of the motor 4.

The mean diameter Dm 33 represents the inner limiting diameter of the outer surface 7 of the hub contour 2, which guides the main flow. Within this boundary provided by Dm 33, the hub contour 2 has its inner opening 6. Dm 33 can be regularly defined by the location of the hub contour 2 at its maximum axial extension towards the inflow side. In the exemplary embodiment, the hub contour 2 has a rather sharp-edged bend at the boundary given by Dm 33, but it can also be designed to be more rounded there.

The angle of a tangent to the outer surface 7 of the hub contour 2 measured to the axis decreases, as seen in section, continuously from the boundary Dm 33 in the main flow direction until the outer surface 7 merges approximately tangentially into the outer contour of the hub ring 10. A good effectiveness of the hub contour 2 is achieved above all when the outer surface 7 guiding the main fan flow extends over a sufficiently large diameter range. Thus, it was found that Da 32–Dm 33 is >=3% of the impeller outer diameter DL 34. Regardless, Da 32 is greater than 110% of Dm 33.

The hub contour 2 is centered and fastened to the impeller 3 by front fastening means 23 provided within its the hub ring 10. For example, it can be secured by gluing or clipping. The impeller 3 is fastened to the rotor 11 of the motor 4 by means of fastening means 15 arranged within the hub ring 10. On the outer contour of the housing 13, the regions of the inlet nozzle 5, the cylindrical region 20 and the diffuser 21 are clearly visible in section. The impeller 3 with its blades 9 with the winglets 22 runs, viewed in the axial direction, largely (at least for 90% of the axial extension of the winglets 22) or completely in the cylindrical region 20. On the suction side of the guide vanes 14, the demolding regions 26 are clearly visible in the diffuser region 21.

Figure 3:
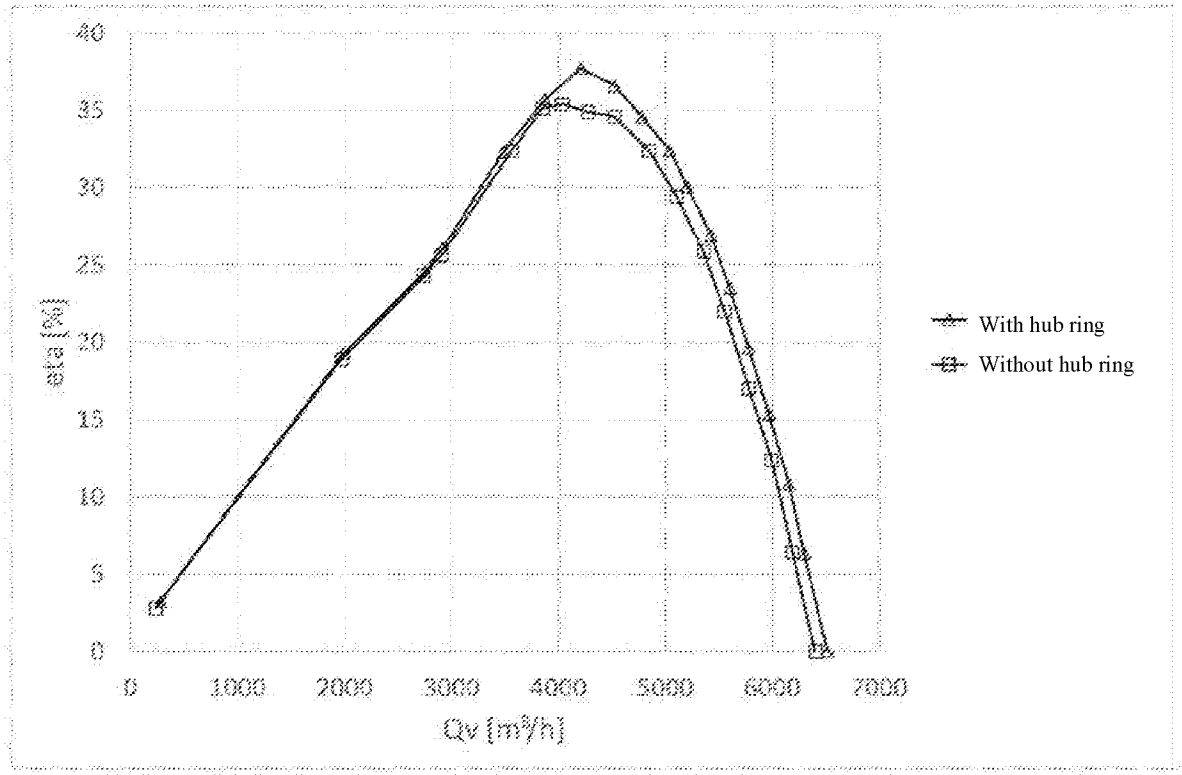
FIG. 3 shows a diagram showing the efficiency curve as a function of the volumetric flow rate for a fan with and without an aerodynamically designed hub contour for a constant impeller speed.

In FIG. 3, two characteristic curves of comparable axial fans at a certain constant motor speed are shown in a diagram with the volumetric flow rate QV on the abscissa and the efficiency $\eta$ on the ordinate (in the example a static or total-to-static system efficiency is shown). In one embodiment, there is no hub contour with an outer surface with a streamlined flow-guiding contour on the inflow side (square symbols), but in the other embodiment, which is otherwise identical, there is such a hub contour with an outer surface with a streamlined flow-guiding contour (triangle symbols). It can be seen that as a result of the application of a hub contour with an outer surface with a streamlined flow-guiding contour, the air performance is increased (higher maximum volumetric flow QV) and the efficiency is increased over large regions of the characteristic curve, here in particular the maximum static system efficiency is increased by about 2% points or relatively by about 6%. Typically, the static efficiency can be increased by about 0.1-10% by using a hub contour.

Figure 4:
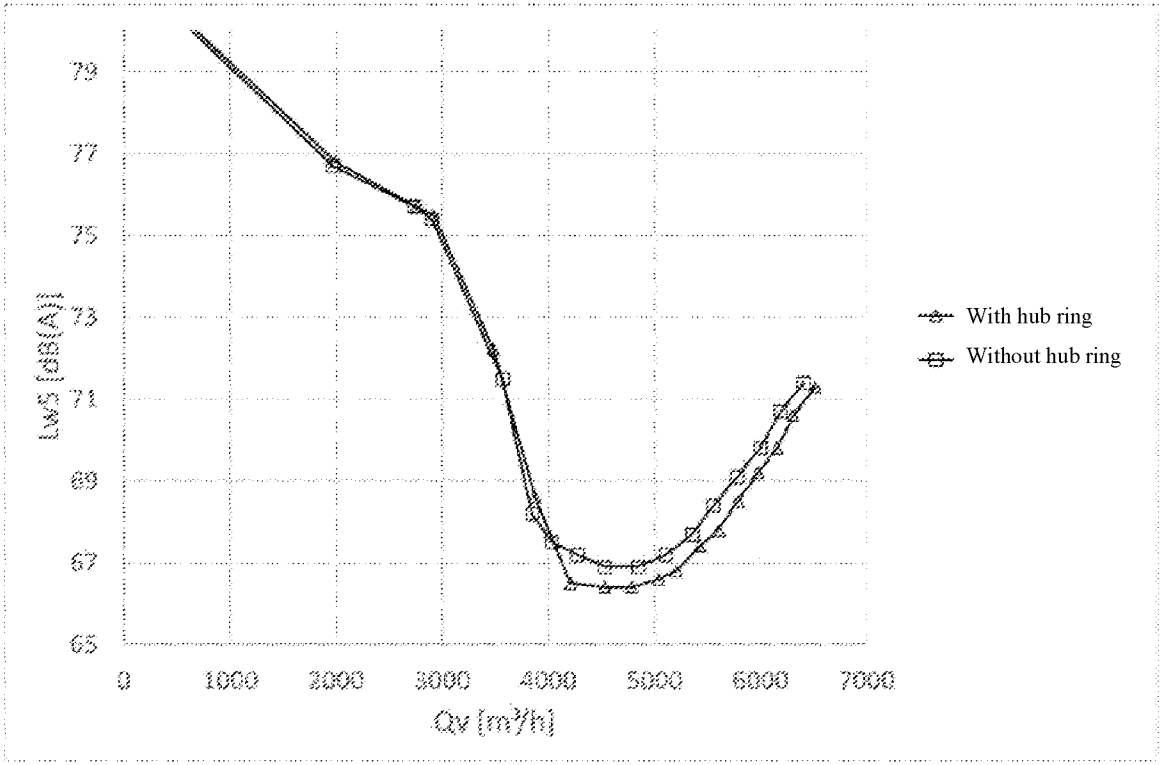
FIG. 4 shows a diagram showing the curve of a sound power level as a function of the volumetric flow rate for a fan with and without an aerodynamically designed hub contour for a constant impeller speed.

In FIG. 4, two characteristic curves of comparable axial fans at a certain constant motor speed are shown in a diagram with the volumetric flow rate QV on the abscissa and an A-valued suction-side sound power level LW5(A) on the ordinate, analogous to FIG. 3. In one embodiment, there is no hub contour with an outer surface with a streamlined flow-guiding contour on the inflow side (square symbols), but in the other embodiment, which is otherwise identical, such a hub contour with an outer surface with a streamlined flow-guiding contour (triangle symbols) is provided. It can be seen that as a result of the application of a hub contour with an outer surface with a streamlined flow-guiding contour, the sound power is reduced over large regions of the characteristic curve, in particular the minimum sound level is reduced by about 0.7 dB. Typically, the minimum sound level can be reduced by about 0-3 dB by using a hub contour. It was found that the advantages in terms of noise generation of the use of a hub contour with an outer surface with streamlined flow-guiding contour are particularly pronounced when using a guide wheel with guide vanes. Vortices that can arise in the hub region due to an aerodynamically unfavorable design of the inflow region of a fan impeller can interact with guide vanes mounted downstream of the impeller, generating a lot of noise. For fans with guide wheel, it is therefore advantageous to use a hub contour with an outer surface with a streamlined flow-guiding contour.

Figure 5:
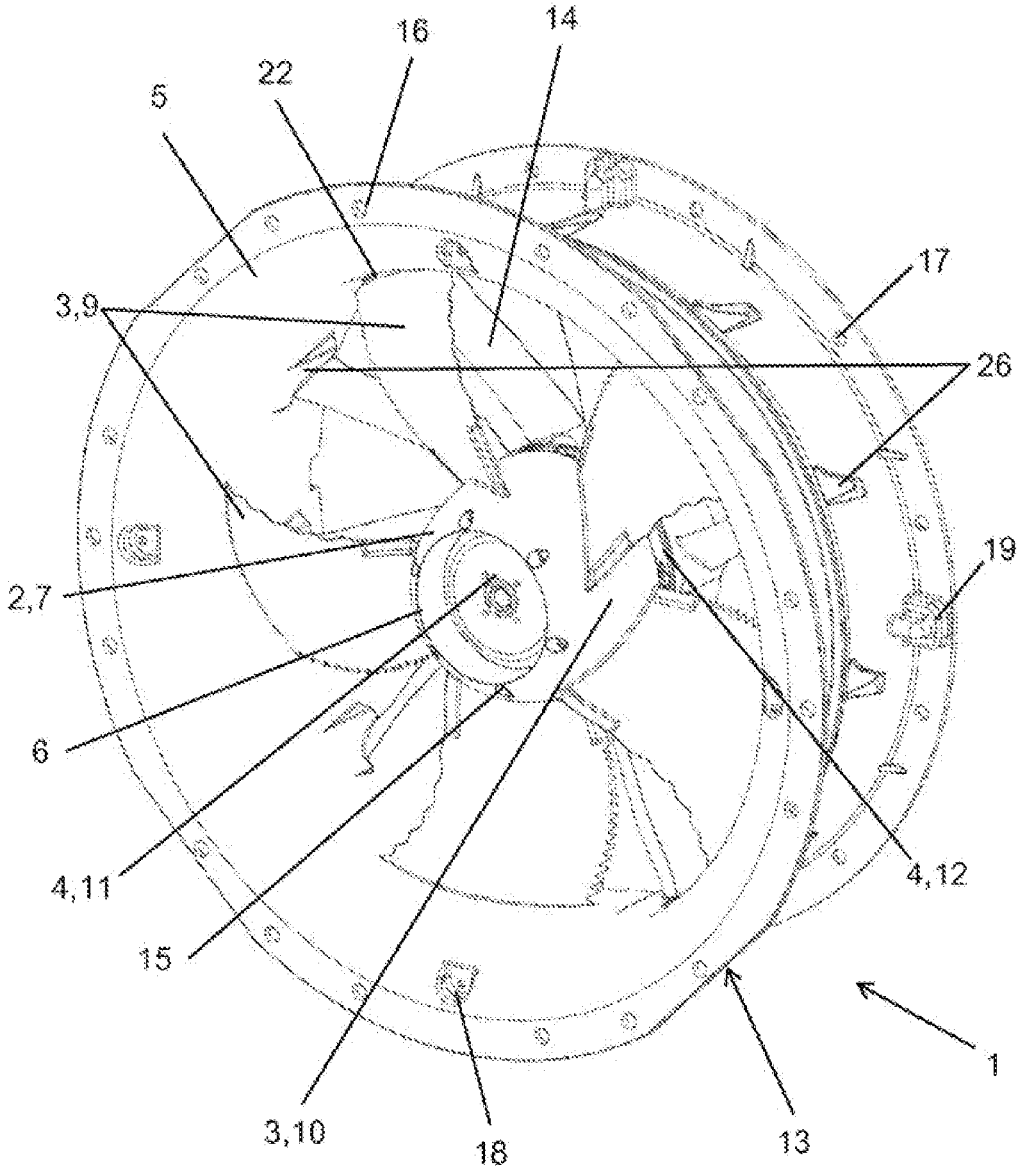
FIG. 5 shows, in a perspective view, seen obliquely from the inflow side, a fan with an embodiment of an inflow-side open and aerodynamically designed hub contour, wherein the hub contour is integrated into a conical hub of an impeller.

FIG. 5 shows a perspective view, seen obliquely from the inflow side, of a fan 1 with an embodiment of an aerodynamically designed hub contour 2 that is open on the inflow side. In the exemplary embodiment, the hub contour 2 is integrated in one piece on a hub ring 10 of an impeller 3 which is fastened to the rotor 11 of the motor 4 with fastening means 15, for example with screws. The blades 9 of the impeller 3 are also provided with a contour 22 (winglet) at the radially outer end, which in the embodiment has a different shape than in the embodiment according to FIG. 1 and FIG. 2. In an embodiment, a bevel is formed on the suction side of the blades 9, so that only a very thin web remains radially outside on the blades 9. Furthermore, apart from the hub design, reference is also made to the descriptions of FIGS. 1 and 2, which embodiment has many analogies to the one shown here.

Figure 6:
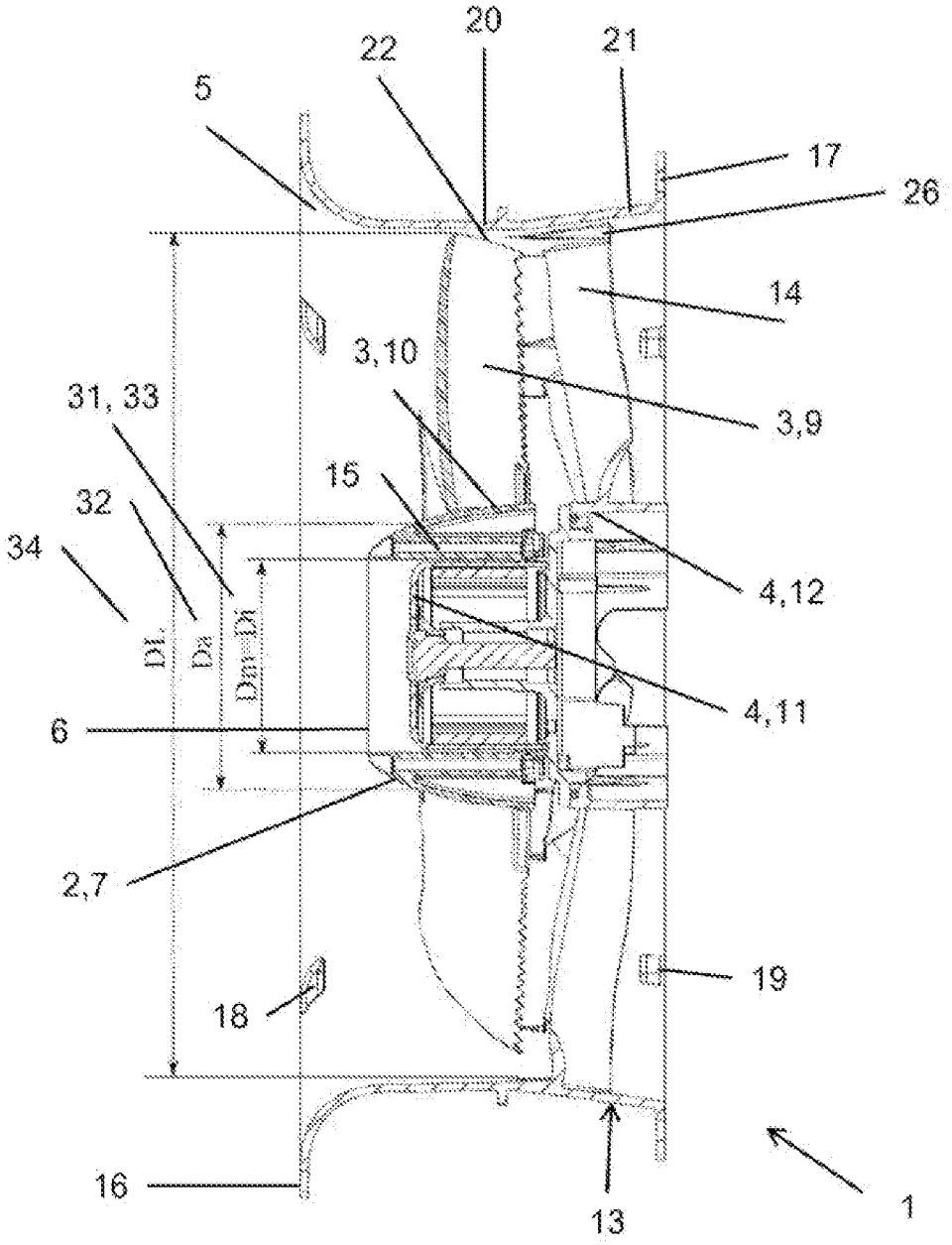
FIG. 6 shows, in section on a plane through the rotation axis of the impeller, seen from the side, the fan according to FIG. 5.

FIG. 6 shows the fan according to FIG. 5 in section on a plane through the axis of rotation of the impeller, seen from the side. Here, too, it can be seen that the hub contour 2 is integrated in one piece together with the hub ring 10 of the impeller 3. The diameter Da 32, which defines the outer boundary of the hub contour 2 or the transition to the hub ring 10 of the impeller 3, can be defined here at the axial position of the flow-guiding surface 7 of the hub contour 2, at which the vanes 9 on the hub ring 10 begin. The hub ring 10 itself is conical over the entire axial extension of the blades 9 of the impeller 3, namely its outer contour does not run parallel to the axis. Fastening means 15 for fastening the impeller 3 to the rotor 11 of the motor 4 are integrated into the overall hub, consisting of the hub ring 10 and the hub contour 2. In the exemplary embodiment, the inner diameter Di 31 is identical to the mean diameter Dm 33, which defines the radially inner boundary of the flow-guiding outer surface 7 of the hub contour 2. Within the opening 6 of the hub contour with the diameter Dm 33, no walls or the like of the hub contour 2 extend.

Figure 7:
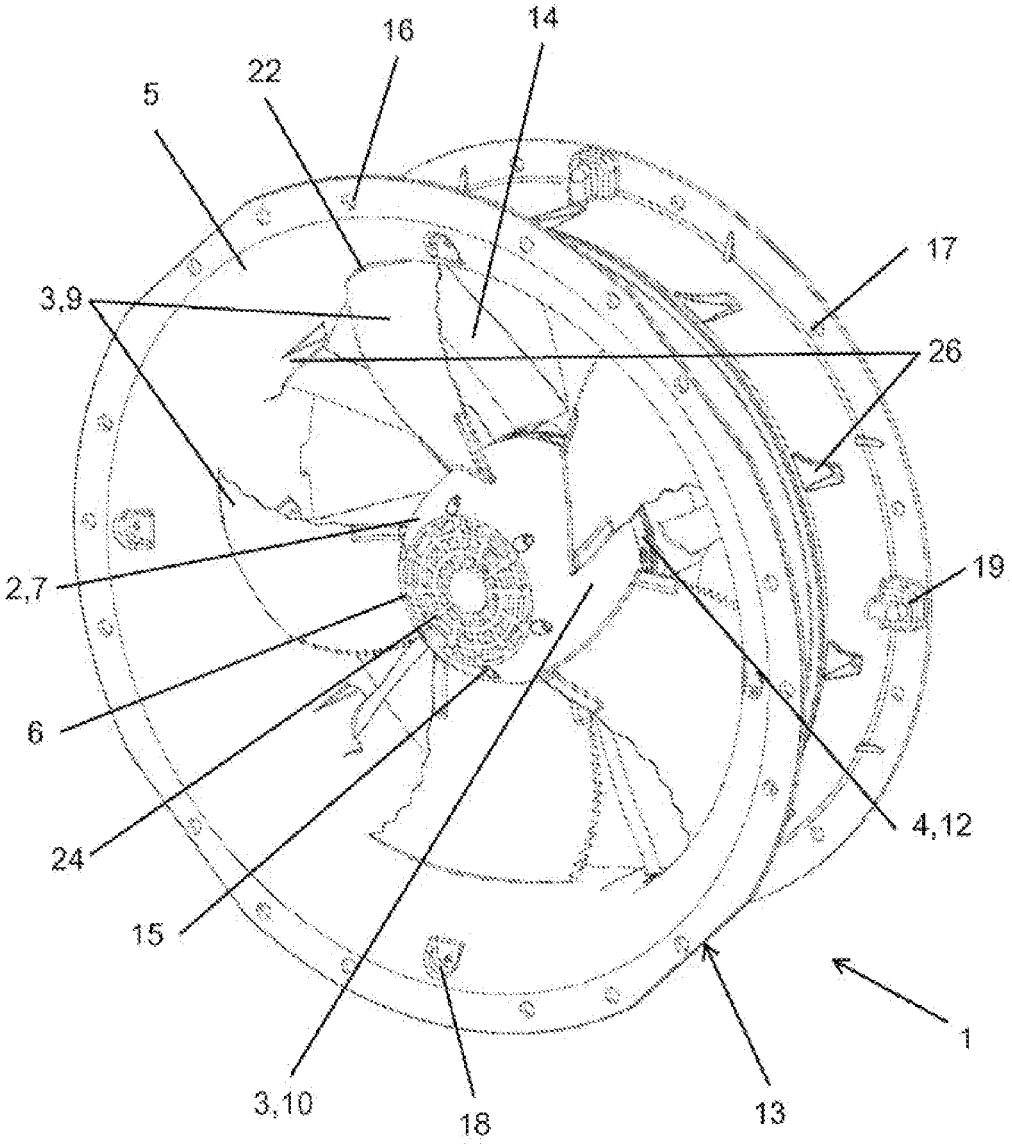
FIG. 7 shows, in a perspective view obliquely seen from the inflow side, a fan with an embodiment of an inflow-side open and aerodynamically designed hub contour, wherein the hub contour is integrated in a conical hub and an inflow-side grid is integrated in the hub contour.

FIG. 7 shows a perspective view, seen obliquely from the inflow side, of a fan 1 with an embodiment of an aerodynamically designed hub contour 2 that is open on the inflow side. In contrast to the embodiment according to FIG. 5, a sort of grid structure 24 is designed in the inner region of the hub contour 2. Due to the openings in the grid structure 24, the hub contour 2 is still open and circulation of inflow-side conveying medium on the rotor 11 of the motor 4 for the purpose of good motor cooling is still ensured. The outer contour of the grid structure 24 continues the contour of the flow-guiding surface 7, which by definition extends radially inwards to the beginning of the grid openings, preferably in a tangentially continuous manner. This embodiment may have several advantages compared to the embodiment according to FIG. 5. On the one hand, the motor is mechanically protected on the suction side and to a certain extent against coarse contamination. On the other hand, the additional blocking effect due to the outer contour of the grid structure 24 can have a beneficial effect on the main flow and thus on the efficiency and low noise level of the fan 1. Ultimately, a more visually appealing appearance of the fan can also be achieved. The shape and distribution of the openings and webs of the grid structure 24 can be designed in a variety of ways; structured or unstructured or also with openings of a more round shape.

Figure 8:
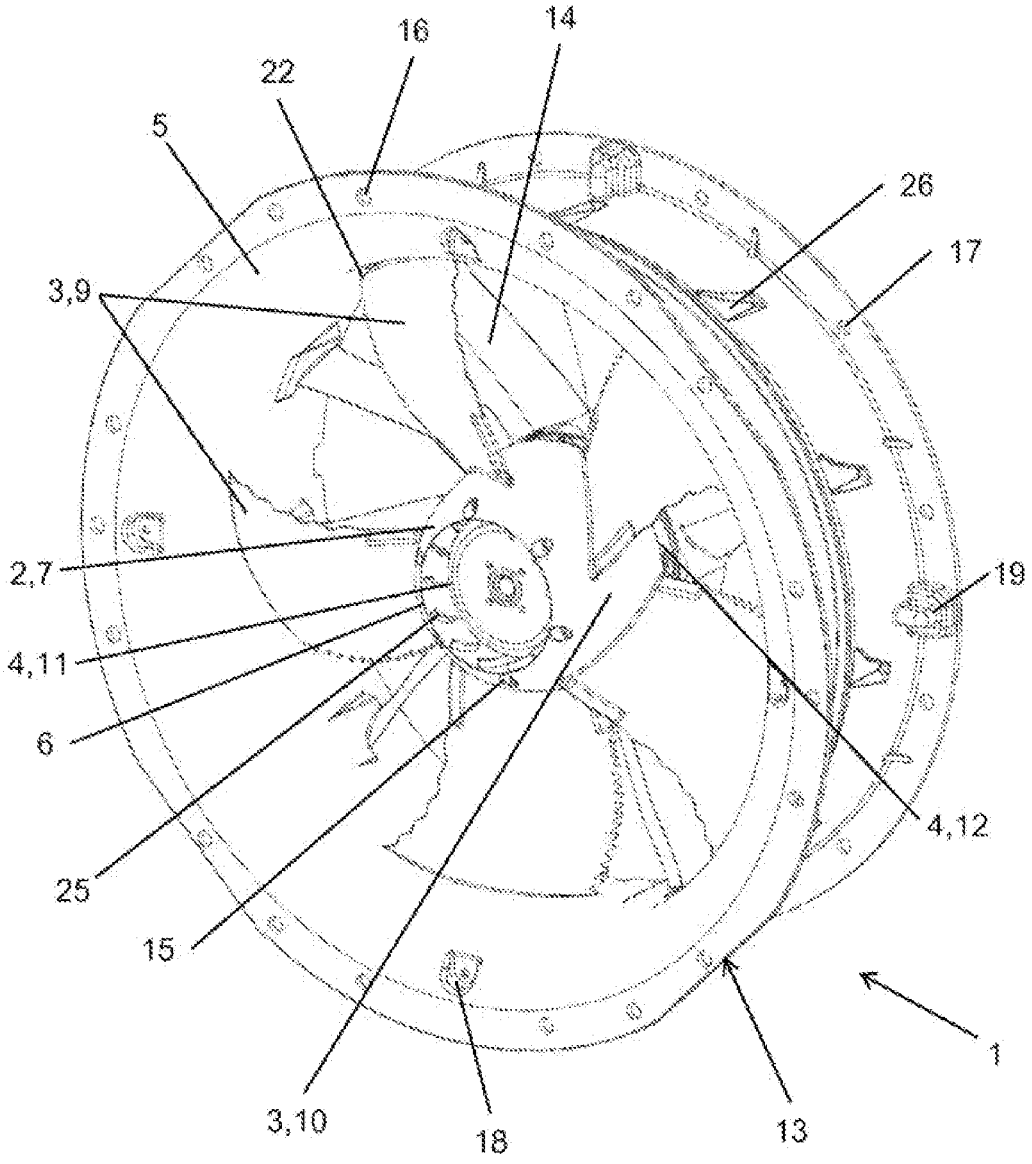
FIG. 8 shows, in a perspective view obliquely seen from the inflow side, a fan with an embodiment of an inflow-side open and aerodynamically designed hub contour, wherein the hub contour is integrated in a conical hub of an impeller and inner cooling flow elements are integrated in the hub contour.

FIG. 8 shows a perspective view, seen obliquely from the inflow side, of a fan 1 with an embodiment of an aerodynamically designed hub contour 2 that is open on the inflow side. In contrast to the embodiment according to FIG. 5, active flow elements 25 are formed in the inner region of the hub contour 2, radially inside the opening 6 of the hub contour 2 or in the inner region assigned to the motor cooling, which elements actively and positively influence the cooling flow around the rotor 11 of the motor 4. In particular, they can cause stronger vortex formation and/or locally higher flow velocities and/or greater air circulation in the inner region of the hub contour 2 or in the region of the rotor 11 of the motor 4. The rotational movement of the impeller 3 with its blades 9 and its hub ring 10 as well as the hub contour 2 is used to this end. In the embodiment, the flow elements 25 resemble small stub wings that are curved. They are attached to the hub contour 2 on the inside, within its opening 6, and are, in an embodiment, manufactured in one piece with the impeller. Their effect depends on the direction of rotor rotation, since they are not formed symmetrically with respect to the direction of rotation. However, this is generally not a restriction, since the direction of rotation of the impeller 3 is predetermined by its geometric design anyway.

Figure 9:
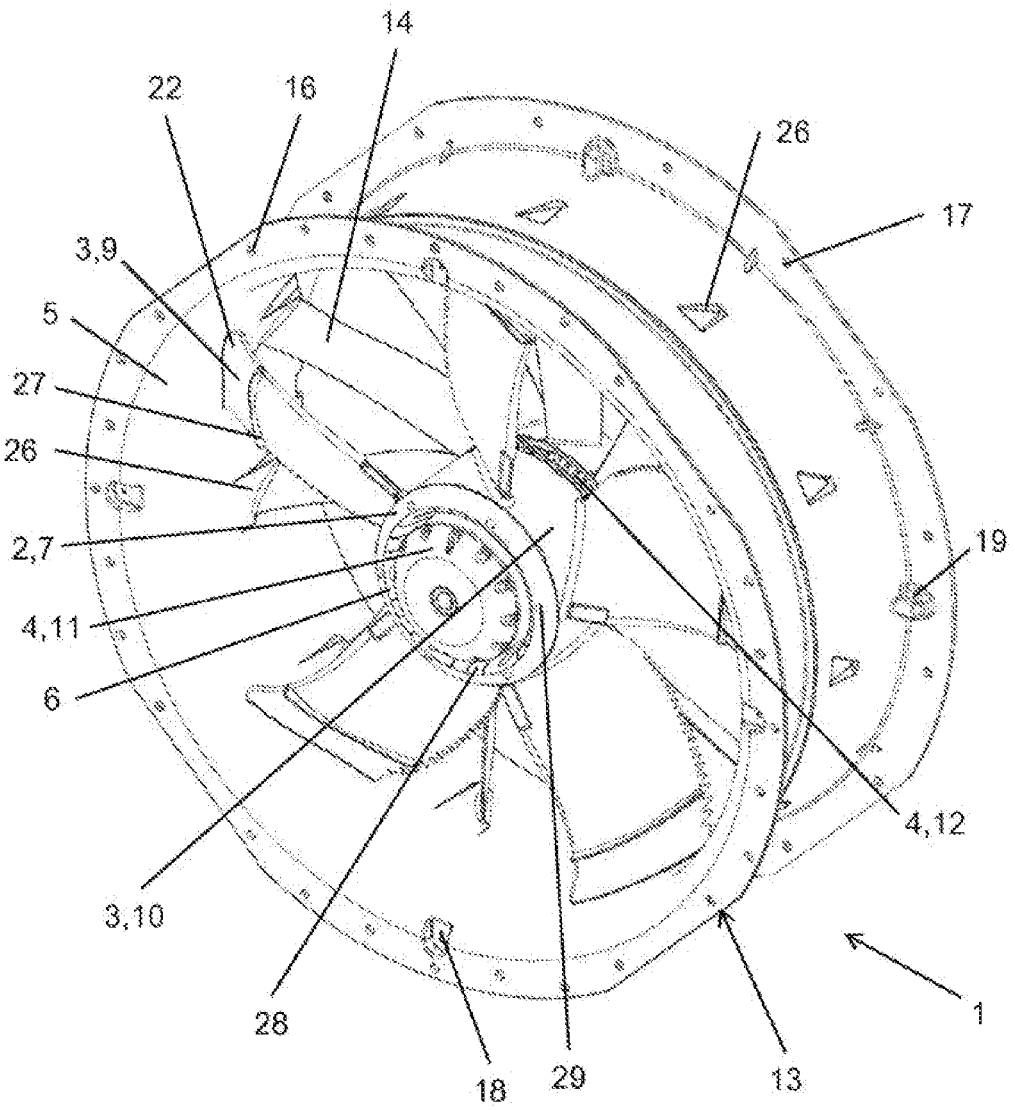
FIG. 9 shows, in a perspective view obliquely seen from the inflow side, a fan with an embodiment of an inflow-side open and aerodynamically designed hub contour, wherein the hub contour is designed as a separate part for attachment to an impeller.

FIG. 9 shows, in a perspective view obliquely seen from the inflow side, a fan 1 with an embodiment of an inflow-side open and aerodynamically designed hub contour 2, wherein the hub contour 2 is designed as a separate part with integrated fastening elements 29. The rotor 11 of the motor 4 projects through the opening 6 of the hub contour 2 axially beyond the latter towards the inflow side. The rather rounded front part of the rotor 11, the rotor bell, can interact with the flow-guiding outer surface of the hub contour 2 with regard to the main fan flow near the axis. In the exemplary embodiment, the blades 9 of the impeller 3 also have, in addition to the radially outer winglets 22, intermediate winglets 27, designed as structures on the suction side of the blades 3. Within the opening 6 of the hub contour 2, blades 28 are integrated on the hub contour 2. These have a certain flexibility and adhere to the rotor 11 of the motor 4, even if the diameter of the rotor 11 is variable. Beyond that, reference can be made to the description of, for example, FIG. 1.

Figure 10:
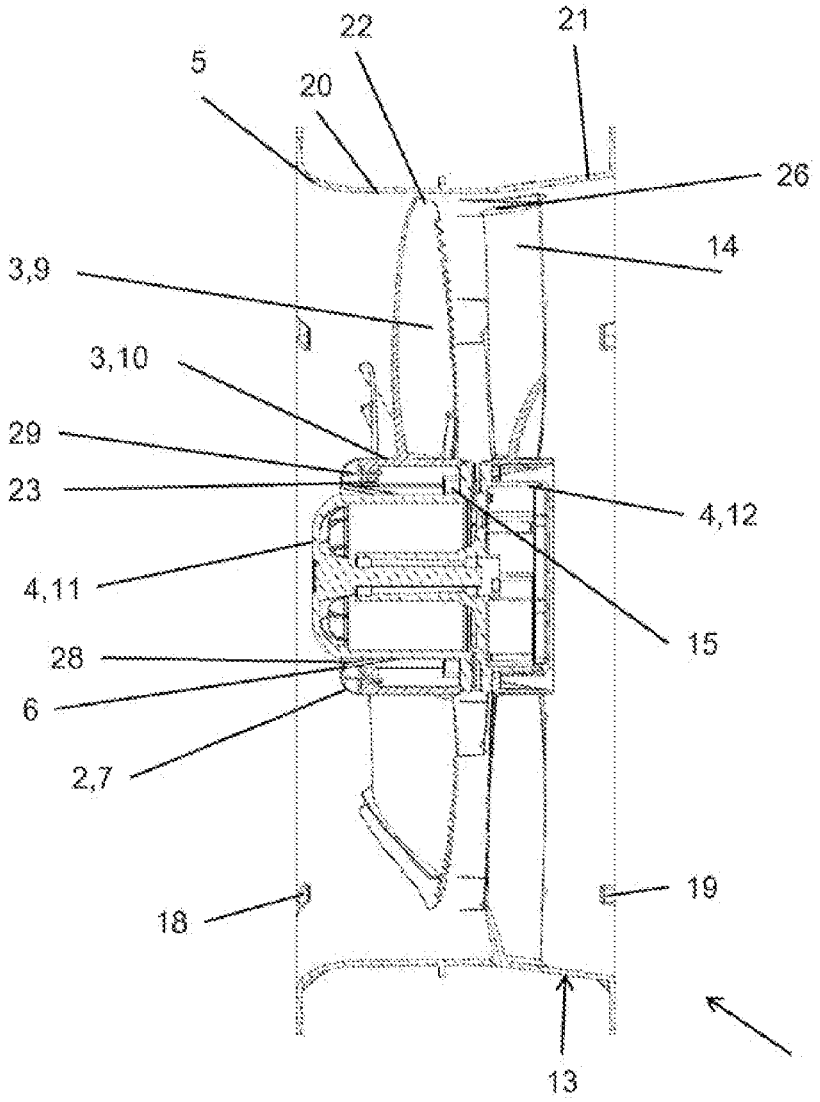
FIG. 10 shows, in section on a plane through the rotation axis of the impeller, seen from the side, the fan according to FIG. 9.
Figure 10B:
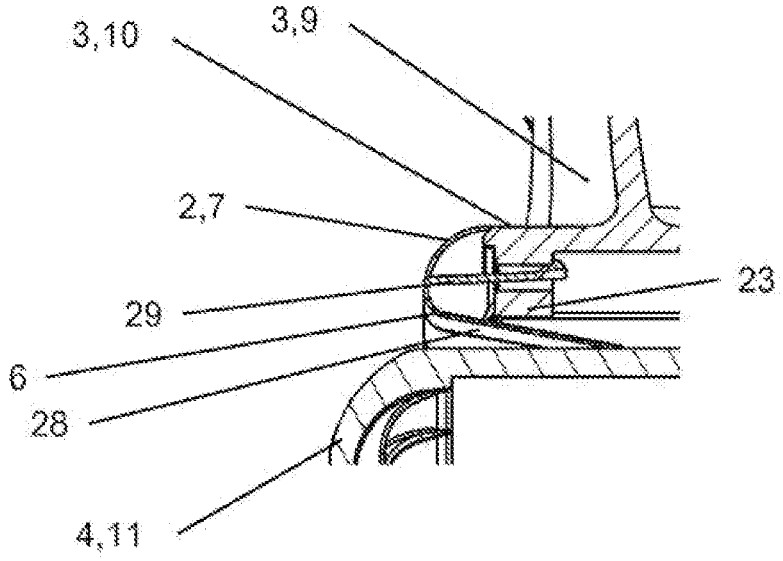
FIG. 10*b* shows an enlarged detailed view in the region of the hub contour from FIG. 10.

FIG. 10 shows the fan 1 according to FIG. 9 in section on a plane through the axis of rotation of the impeller 3, seen from the side. In FIG. 10*b*, a region of the hub contour of the fan 1 from FIG. 10 is shown in an enlarged detailed view. In FIG. 10 it can be seen that the hub ring 10 of the impeller 3 is essentially cylindrical. The fastening means 15 integrated within the hub ring 10 for fastening the impeller 3 to the rotor 11 of the motor are essentially identical to the fastening means 29 integrated on the inflow side within the hub ring 10 for fastening the hub contour 2 to the impeller 3 or its hub ring 10. This allows the impeller 3 to be mounted on the rotor 11 of the motor 4 in a reversed manner with respect to the conveying direction, for example to use the impeller 3 without a guide wheel or guide vane.

The blades 28 integrated into the hub contour 2 adhere the rotor 11 of the motor 4 (FIG. 10*b*). Snap hooks serve as fastening means 29 of the hub contour 2 on the hub ring 10 of the impeller 3, which engage in the openings of the front fastening means 23 on the hub ring of the impeller 3. This makes it possible to easily attach the hub contour 2 to the impeller 3 with its hub ring 10 without the need for additional fastening elements or tools. The flow-guiding outer surface 7 of the hub ring 2 merges approximately tangentially into the outer surface of the hub ring 10 of the impeller 3. In the region axially opposite the snap hooks acting as fastening means 29 of the hub contour 2 on the impeller 3 or its hub ring 10, the flow-guiding surface 7 of the hub contour 2 is interrupted by recesses (see also FIG. 9). These are used to enable the snap hooks to be demolded in a direction parallel to the axis using an injection molding tool.

To avoid repetition with regard to further embodiments of the fan according to the disclosure, reference is made to the general part of the description and to the appended claims.

Finally, it should be expressly noted that the above-described exemplary embodiments of the fan according to the disclosure merely serve to discuss the claimed teaching, but do not restrict it to the exemplary embodiments.

LIST OF REFERENCE NUMERALS

1 fan
2 inflow-side hub contour
3 Fan impeller, impeller
4 motor
5 inlet nozzle
6 inner opening of a hub contour, opening
7 flow-guiding surface of a hub contour, exterior surface
8 not used
9 blades of an impeller
10 hub ring of an impeller
11 motor rotor
12 motor stator
13 fan housing
14 fan guide vane
15 fastening device of the impeller on the motor
16 inflow-side fastening device of the fan to a system
17 outflow-side fastening device of the fan to a system
18 inflow-side fastening device of a grid on the housing
19 outflow-side fastening device of a grid on the housing
20 cylindrical flow region in the housing
21 integrated exhaust diffuser
22 winglet/outer contour of a blade
23 front fastening device integrated on the impeller

24 inflow-side grid structure integrated into the hub contour
25 active cooling flow elements inside the hub contour
26 demolding regions in the region of the diffuser of the housing
27 intermediate winglet
28 plates
29 fastening means of hub contour-impeller hub
30 not used
31 inner diameter Di of the hub contour
32 outer diameter Da of the hub contour
33 mean diameter Dm of the hub contour
34 impeller diameter DL

The invention claimed is:

1. An axial, diagonal or radial fan, comprising:

an impeller;

an electric external rotor motor configured to drive the impeller;

a hub ring of the impeller carrying blades which is connected in a rotationally fixed manner to a rotor of the electric external rotor motor, wherein a hub contour is provided on an inflow side on the hub ring, the hub contour having a flow-guiding outer surface and a central opening adjoining the outer surface radially inwards with an inner surface directed towards the rotor, wherein the rotor projects beyond the hub contour towards the inflow side and elastic blades are provided within the hub contour, wherein the elastic blades are configured to cling to a respective surface of the rotor or additional different rotors having different respective outer diameters.

2. The fan according to claim 1, wherein the hub contour is designed as a separate component and is plugged, clipped or otherwise fastened to the impeller in at least one of:

a form-fitting manner;

a force-fitting manner; and a material-fitting manner.

3. The fan according to claim 2, wherein the hub contour is fastened to the hub ring with fastening means which are materially integrated either with the hub ring or the hub contour.

4. The fan according to claim 2, wherein the hub contour can be fastened to the hub ring without tools.

5. The fan according to claim 1, wherein the outer surface of the hub contour is free of steps, edges, or kinks.

6. The fan according to claim 1, wherein the outer surface of the hub contour merges approximately tangentially into an outer contour of the hub ring of the impeller.

7. The fan according to claim 1, wherein the outer surface of the hub contour has a sharp-edged or rounded transition to the inner surface of the hub contour around the central opening.

8. The fan according to claim 1, wherein the inner surface defines an inner diameter which approximately corresponds to one respective outer diameter of the different respective outer diameters of a respective front part of one rotor among the rotor and the additional rotors.

9. The fan according to claim 1, wherein the position of the hub contour is adjustable.

* * * * *